US005173565A

United States Patent [19]

Gunn

[11] Patent Number: 5,173,565

[45] Date of Patent: Dec. 22, 1992

[54] ROLLER BRIDGE SADDLE

[76] Inventor: Dennis R. Gunn, Tashiro-So East rm.1 1st fl., Kami Ochiai 2-9-2, Shinjuku-ku, Tokyo, Japan

[21] Appl. No.: 336,846

[22] Filed: Apr. 12, 1989

[51] Int. Cl.[5] ..... G10D 3/04

[52] U.S. Cl. ..... 84/298; 84/307

[58] Field of Search ..... 84/298, 299, 307

[56] References Cited

U.S. PATENT DOCUMENTS 4,453,443 6/1984 Smith ..... 84/298
4,487,100 12/1984 Storey ..... 84/299
4,742,750 5/1988 Storey ..... 84/298

*Primary Examiner*—Michael L. Gellner

*Assistant Examiner*—Eddie C. Lee

[57] ABSTRACT

A bearing of a roller string guide for a musical instrument, such as a roller bridge saddle, is urged into a seating by elastic member whose spring force preferably is greater than the lateral force exerted on the roller by the vibration of the string. The seating of the bearing is formed in a rigid structure of the bridge saddle. With this arrangement since the bearing is urged into a rigid seating the vibrational energy of the string cannot vibrate the roller laterally relative to the bridge saddle and therefore no vibrational energy of the string is lost in the connection between the roller and the saddle structure. With a bridge having a bearing saddle according to the invention string sustain is greatly enhanced.

12 Claims, 10 Drawing Sheets

ROLLER BRIDGE SADDLE

FIELD OF THE INVENTION

The present invention relates generally to an improved, wear reducing bearing arrangement for eliminating lateral play in a roller. The bearing arrangement according to the invention is particularly applicable for the roller bridge saddles of stringed musical instruments.

BACKGROUND

In the art of stringed musical instruments particularly electric guitars and basses, the mass, density, and structural rigidity of the bridge structure, including the bridge saddles across which the strings pass at one or more speaking end thereof, has an enormous effect on the vibrating characteristics of the strings of the instrument. Specifically the lateral and vertical rigidity of the bridge saddles and the mass of the support structure determine how much of the string's kinetic energy will be absorbed by the instrument structure during the period after which the string has been exited into vibration. The more solid and massive the structure, the less the energy loss in the string. Among musicians, generally speaking, the longer the string vibrates after being plucked, i.e. the longer the "sustain" of the instrument, the better. Therefore dense, rigid bridge structures are popular.

In musical instruments, another important consideration apart from the "sustain" is the ability of the instrument to stay in tune. If excessive friction, in the longitudinal direction, is encountered at some point between the anchored ends of the strings of the instrument, during playing and/or tuning of the instrument, inequities in the tension in the string at either side of the point of the friction occur.

In practice this means that if, for example, the speaking portion of a string is manually stretched or "bent", during playing, enough that the point of the string that engages a high friction point on a bridge saddle is drawn across the saddle toward the speaking portion of the string, when the manual bending tension is released, due to the friction of the bridge saddle, the point of the string that engages the bridge saddle may not be the same as the point of the string that engaged the bridge saddle before bending. The result will then be that the tension and therefore the tuning of the speaking portion of the string will not be the same.

The tuning characteristics of instruments having the above problem are exasperatingly unstable.

In order to stabilize the tuning characteristics of stringed instruments, bridges and nuts encorporating rollers intended to eliminate longitudinal friction in the string path are well known. However in these systems the problem of lateral play exists in the bearings of the rollers. This lateral play tends to absorb the kinetic energy of the string and thus kill the sustain of the string. The lateral play in the rollers also tends to result in unpleasant noises and rattling as well as adding unpleasant harmonics to the string vibrations.

In pin bearings, this lateral play can sometimes be eliminated by tightening the seating of the bearing however this results in friction in the roller which negates the friction reducing effect the roller was initially intended to provide.

SUMMARY OF THE INVENTION

In view of the above problems inherent in the existing bridge saddle systems it is the purpose of the instant invention to provide a low friction bearing structure by which lateral play, along the axis of rotation of a roller can be virtually eliminated.

It is a further aim to provide a roller bearing structure which can be produced inexpensively and is easy to install.

It is a further aim of the invention to provide a roller bearing which is so configured as not to become loose due to wear.

It is a further aim of the invention to provide a roller structure which is effectively rigid against alternating thrusts in the directions of the rotational axis and whose rotational friction is small.

The above objects are accomplished in a bearing according to the instant invention by providing a bearing in which the engaging surfaces of the bearing and its seating are elastically biased into engagement such that if the bearing wears the biasing force of the elastic engaging means simply drives the bearing deeper into its seating so the bearing does not become loose.

According to another aspect of the present invention the bearing of a roller according to the invention is elastically biased into a rigid seating in such a manner that vibrational force of a given magnitude applied to the roller in the axial directions thereof are insufficient to overcome the elastic biasing force and cause the roller to vibrate relative to the support structure, thereby ensuring that the vibrational energy is not absorbed in the connection between the roller and its support structure.

In one embodiment of a bearing according to the present invention a roller comprises a pair of rigidly attached pins protruding at either side thereof so as to define the rotational axis of the roller. The pins preferable end in sharp points or have very fine ball ends. In one embodiment the ends of the pins may have ball bearing mounted in them in such a manner as to resemble the tip of a ball point pen. The pins are seated in indentations in the side of a groove formed in the bridge saddle for receiving the roller. Both sides of the groove in the bridge saddle may be flexably biased inwards against the pins so that the pins are forced to remain in the indentations. Preferably one side of the groove is rigid while the other side is flexible so as to provide the elastic biasing force on the pins for holding them in the indentations.

The effect of the latter arrangement is that, as long as lateral forces on the roller do not exceed the biasing force of the elastic side of the groove, the roller will not move laterally at all, relative to the support structure.

By forming the groove comprising the indentations and the pins of a very hard material, such as spring steel, and providing fine points on the pins a great deal of biasing force can be used to seat the pins so as to prevent radial displacement of the roller from the indentations while still allowing the roller to rotate with very little friction. Due to the elastic biasing method, as the bearing wears no slack occurs on the connection. What is more the width of the groove does not have to be made to extremely close tolerances.

In another embodiment a hole is formed which passes through both sides of the groove and a hole of the same or nearly same diameter is formed through the axial center of the roller. Ball bearings which are slightly in diameter larger than the holes in the roller and the and sides of the groove. The flexible wall of the groove applies elastic force against the ball bearings so that the ball bearings are seated in the holes of the walls of the groove on one side and in the holes in the roller on the other. The material of the ball bearings roller and/or of the walls of the groove are preferably of a very hard material so that the ball bearings do not become jammed into the holes so as to seize and impede rotation of the roller.

In another embodiment of the invention the bearing comprises a V-shaped race formed directly on the periphery of a screw for mounting the roller onto the support structure of the bridge saddle. The roller has a V-shaped race formed on its inner periphery and a plurality of ball bearings are received in the space between the race on the screw and the race of the roller. A wall of the V-groove defining the race of the roller is flexible and the race is small enough in inner diameter that the race must deform to accommodate the ball bearing in the race so that a constant biasing force is applied to the balls so as to keep them urged into the corners of the races.

A reasonable degree of lateral rigidity of the roller can be achieved even if both sides of the race are flexible, but the most lateral rigidity can be achieved when one side of the roller's race is rigid and the other is flexible.

In another embodiment of the invention the race in the screw is comprised of a movable member in the form of a ring having a frusto-conical portion which faces a frusto-conical portion formed on the shank of the screw so that the two members define a V-shaped groove. The roller comprises an inner bearing race and a plurality of ball bearings are received in the space defined by the inner and outer bearing races. Tightening of the screw into a hole in the support structure causes the support structure to engage the ring shaped member so as to diminish the width of the V-groove thus forcing the ball bearings outwards to as to be received firmly into the outer race thus elimination lateral play in the roller.

IN THE DRAWINGS

DETAILED DESCRIPTION OF EMBODIMENTS

Figure 1:
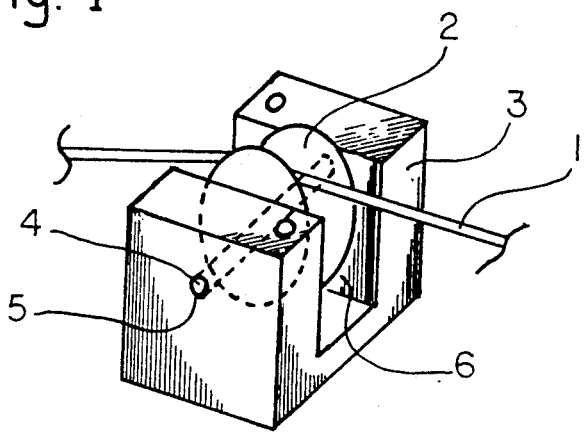
FIG. 1 is a perspective view of a roller bridge saddle according to the prior art.

In FIG. 1, a roller bridge saddle, for a stringed instrument, according to the prior art is shown. As can be seen the roller 2 is supported in the support structure 3 by means of a pin 4 which is received in registered holes which laterally penetrate the saddle body 3. Generally the pin 4 fits snugly in the hole 5 in the body of the saddle but is fits somewhat loosely in the axial hole of the roller 2 so as to allow the roller to rotate relative to the pin 4 and prevent the pin 4 from falling out. In order to avoid inhibiting rotation of the roller the roller fits loosely in the groove.

Various methods are commonly employed the align the roller saddle on the bridge of the instrument however these are well known to those skilled in the art and are omitted from this disclosure for the sake of brevity.

With the above construction it can be appreciated that although the roller is fairly free to rotate and thereby allow the tension to be equalized in both sections of the string 1, lateral vibration of the string 1 causes the roller to vibrate or rattle back and forth in the groove 6. This lateral movement of the roller absorbs the vibrational energy of the string 1 thus diminishing the sustain of the string 1.

Figure 2:
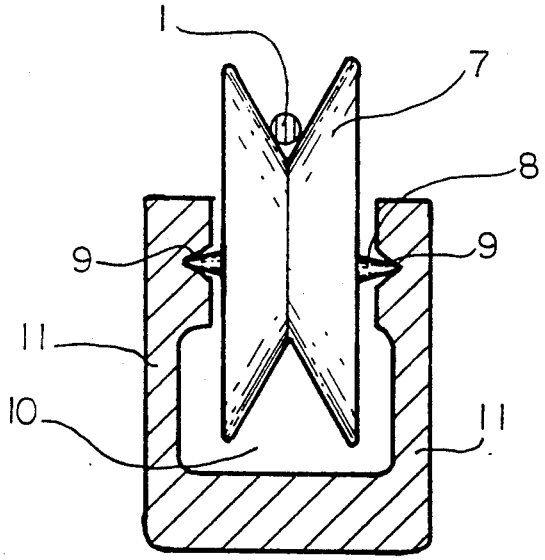
FIG. 2 is a cross sectional view showing the bearing structure of a roller bridge saddle according to a first embodiment of the present invention.

In FIG. 2 a cross sectional diagram of a bridge saddle roller and support structure therefore according to the invention are shown. As can be seen, the roller 7 comprises conical pins 8 which are received in conical indentations 9 in the walls of the groove 10. The walls 11 of the groove 10 are elastically biased inwards by their inherent resilience so that the pins 8 are urged to seat in the bottoms of the indentations 9. The conical indentations 9 are of a slightly shallower angle than the pins 8 so as to minimize the diameter and area of the engaging portions of the bearing.

Due to the small diameter of the engaging portion of the bearing, the walls 11 can be formed so as to apply a large biasing force so as to hold the pins 8 centered at the bottoms of the holes 9. Therefore the downward pressure of the string 1 as it bears on the roller 7 is insufficient to radially displace or dislodge the bearings. On the other hand since the diameter of the engaging portions are small relative to the diameter of the portion of the roller at which the string engages it, the mechanical advantage of the string for rotating the roller is large and therefore the roller 7 offers very little longitudinal resistance to the passage of the string thereover.

The pins may be formed as an integral part of the roller such as by means of casting. Or they may be formed by driving a single pin into a hole formed in the center of the roller 7 so as to form an interference fit.

The walls 11 should be formed so as to be rather stiff so as to diminish the amount of lateral flexing under the vibration force of the string as this flexing will have a tendency to add a non-harmonic resonance at the frequency of spring resonance of the the walls 11. The magnitude of this resonance will be inversely proportional to the stiffness of the walls 11.

While the elastic walls 11 are somewhat flexible in the lateral directions, when they are engaged with the pins of the roller 7, they substantially form planes in the vertical directions so that they are very rigid against pressure from the pin 7 in the radial directions from the indentation. Therefore no string energy is lost to flexing of the wall 11 under the fluctuating downward pressure of the string as it vibrates.

With the above embodiment and marked improvement in sustain characteristics of the string 7 over those achieved with the prior art bridge saddle shown in FIG. 1 is realised.

Figure 3:
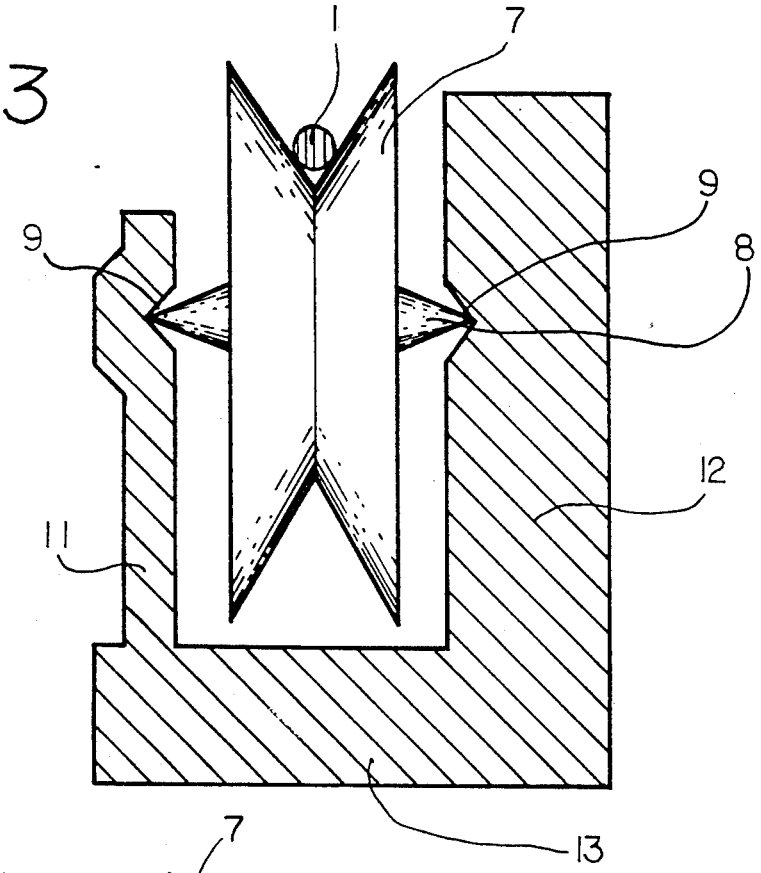
FIG. 3 is a cross sectional view showing the bearing structure of a roller of a roller bridge saddle according to a second embodiment of the present invention.

In FIG. 3 a second embodiment of the invention is shown. The roller is essentially identical to that of the figure 2 embodiment and therefore like numerals have been used to indicate like parts as shall be the convention throughout this disclosure.

As in the previous embodiment the pins 8 are seated in the bottoms of conical indentations 9 in the saddle body. The FIG. 3 embodiment varies from the FIG. 2 embodiment in that only one flexible wall 11 for the groove 10 is provided. The other wall 12 is rigid with respect to the bottom portion 13 which engages the surface of the instrument (not shown). Thus the problem of spring resonance can be eliminated by using only a single spring wall 11. This allows a greater degree of freedom in selecting the thickness of the spring wall and its biasing force.

The biasing force of the wall 11 is selected to be greater than that applied by the string to the roller 7 during vibration of the string. Therefore the pins 8 can never become displaced from the indentations 9.

It will be appreciated that with the above described structure the above embodiment achieves an extremely high degree of rigidity in the lateral directions of the roller 7 while offering little resistance to rotation of the roller.

Figure 4:
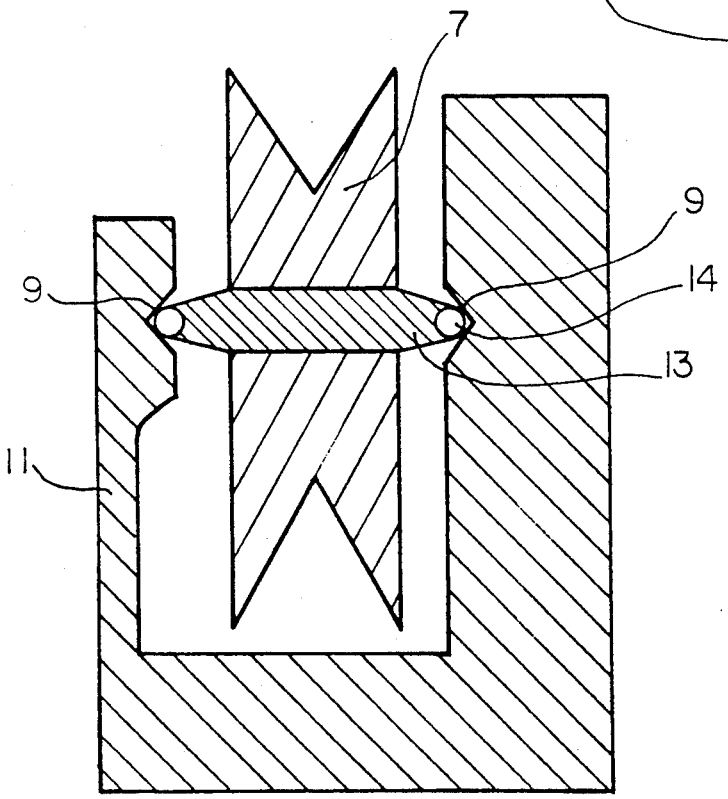
FIG. 4 is a cross sectional view showing the bearing structure of a roller of a roller bridge saddle according to a third embodiment of the present invention.

The third embodiment shown in FIG. 4 is identical to that shown in FIG. 3 except that the pin 13 which is disposed in the axial center of the roller 7 comprises hollow tips in which ball bearings 14 are disposed. It will be further noted that a similar effect could be achieved by providing rounded tips on the pin 13.

Figure 5:
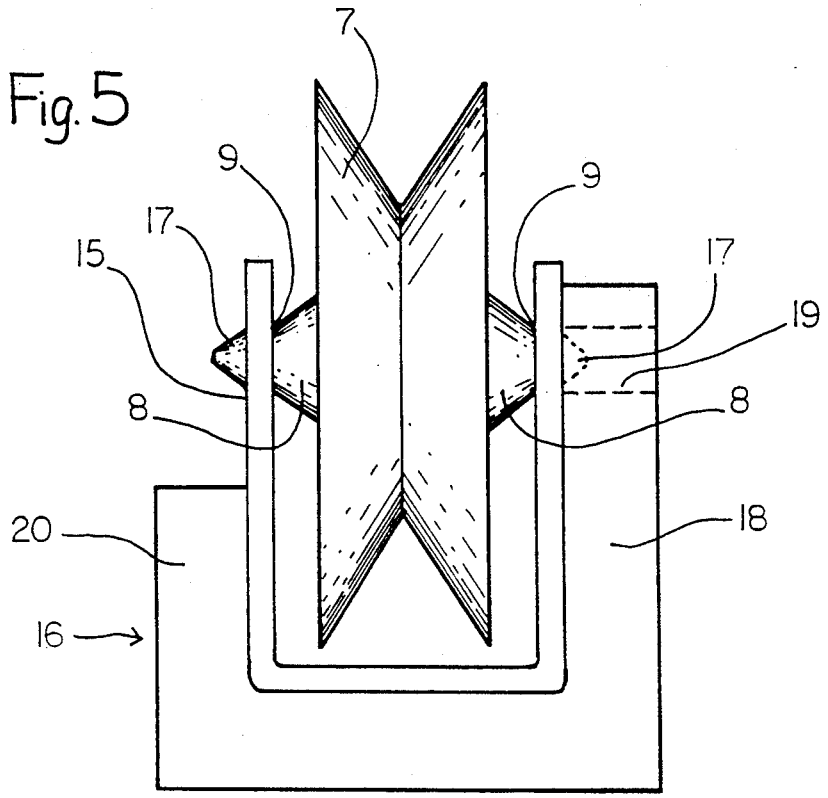
FIG. 5 is a plane view of a roller bridge saddle according to a fourth embodiment of the present invention.

In the fourth embodiment shown in FIG. 5 the roller 7 is preassembled into a spring metal channel member 15 which is then inserted into a rigid channel member 16. The spring metal channel member is punched from sheet metal and may be formed in such a manner as to comprise protrusions 17 at the outer sides thereof in the region of the indentations. On the high rigid side 18 of the rigid channel member 16 a hole 19 may be formed for receiving the protrusion 17 and thereby fix the spring channel member in the rigid channel member. Since the spring channel member is supported on one side by the rigid wall 18 and on the other side stands somewhat above the low rigid channel side 20, the effect is essentially the same as the second embodiment in that one side of the support structure is rigid and the other side is elastic for biasing the bearing pin 8 into the rigid seating and thus assuring lateral stability of the roller 7.

Figure 6:
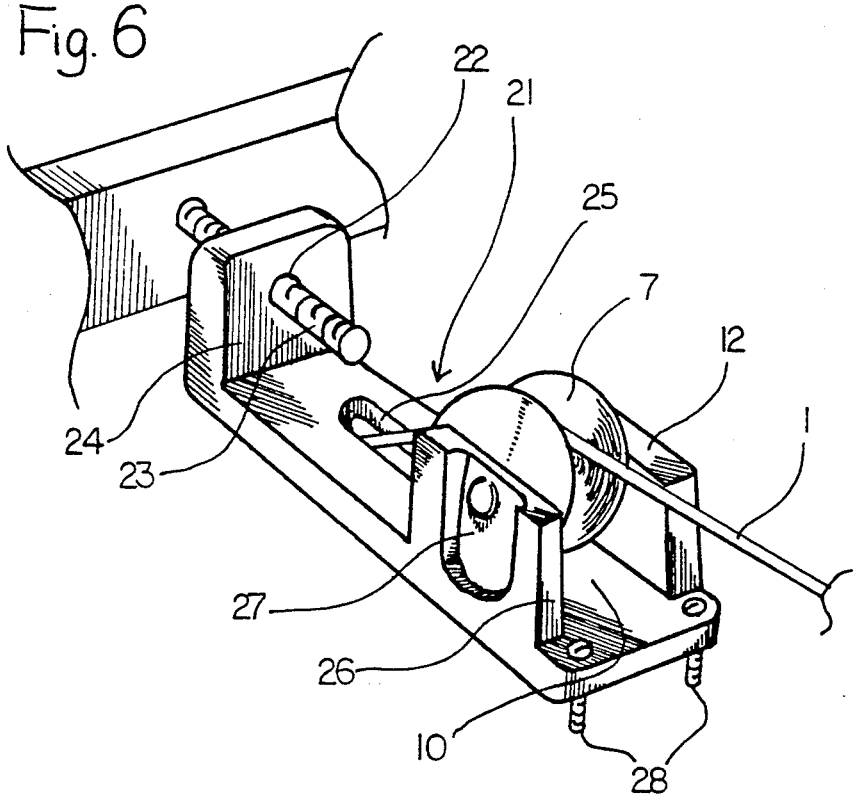
FIG. 6 is a perspective view of a roller bridge saddle according to a fifth embodiment of the present invention.

The fifth embodiment of the invention shown in FIG. 6 exemplifies a structure which could be used as a direct replacement of the most typical type of bridge saddle currently in use on electric guitars formed after the popular Fender Stratocaster (trade name) model.

The saddle 21 comprises a threaded hole, 22 for receiving an intonation adjuster screw 23, formed in vertical tab 24 at the back of the saddle body. An oblong hole 25 is formed so as to allow the string 1 to pass through the bottom of the saddle 21 to an anchoring means (not shown). Optionally, set screws 28 for adjusting the height of the saddle may be provided at the front.

Roller support walls defining a groove 10 are formed at the sides of the saddle body near the front. One wall 12 is basically rigid and comprises an indentation 9 (not visible in FIG. 7) while the other wall 26 comprises a thin flexible portion in which the other indentation 9 (not visible in FIG. 7) is formed.

The pins 8 of the roller 7 (not visible in FIG. 7) seat in the indentations 9 in the same manner as in the above described embodiments. The flexible section 26 is formed in such a manner that it must be flexed outward in order to allow the pin to be seated in the indentations 9. Thus as in the above embodiments the spring force of the section 26 biases the seating indentation 9 against the pin 8 thus firmly seating the pins in the indentations.

It will be appreciated by those skilled in the art that the body of the saddle 21 could be easily and inexpensively stamped from sheet metal.

Figure 7:
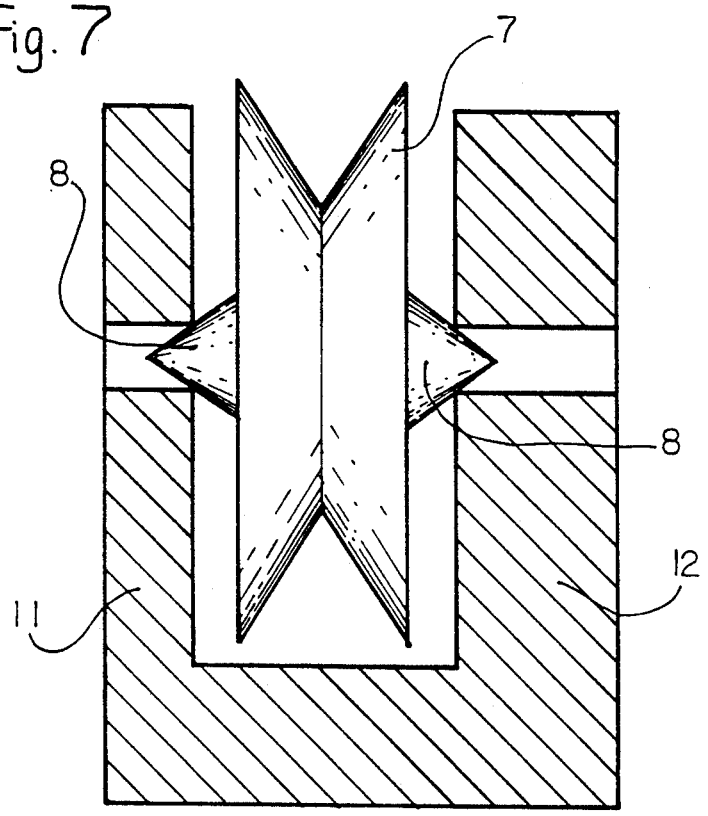
FIG. 7 is a perspective view of a roller bridge saddle according to a sixth embodiment of the present invention.

The sixth embodiment of the invention shown in FIG. 7 is essentially identical to the third embodiment except that registered holes 29 are formed in the place of the indentations 9. This embodiment has the advantage that it is extremely easy to form the holes 29 in accurate alignment by simply drilling through the saddle body.

It will be noted that the holes 29 may be used in place of the indentations 9 in any of the embodiments.

Figure 8:
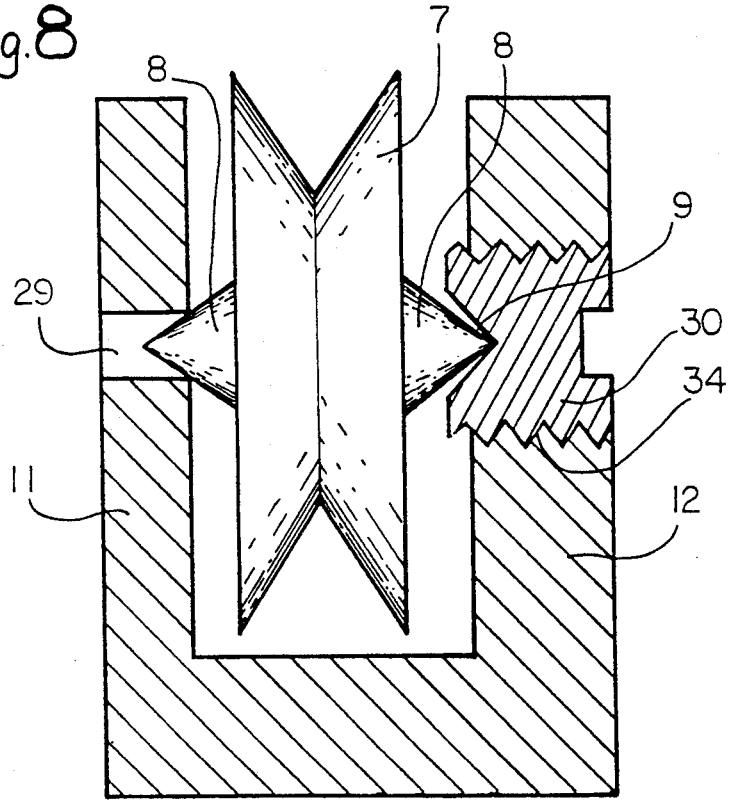
FIG. 8 is a cross sectional view showing the bearing structure of a roller bridge saddle according to a seventh embodiment of the present invention.

In the seventh embodiment shown in FIG. 8 a set screw 30 comprising a conical indentation 9 is provided in a threaded hole 34 the rigid wall 11. The hole receiving the set screw 31 is registered with that 29 in the flexible wall 11. The set screw serves to adjust the biasing force holding the pins 8 in the in the hole 29 and the indentation 9 of the set screw 30.

Figure 9:
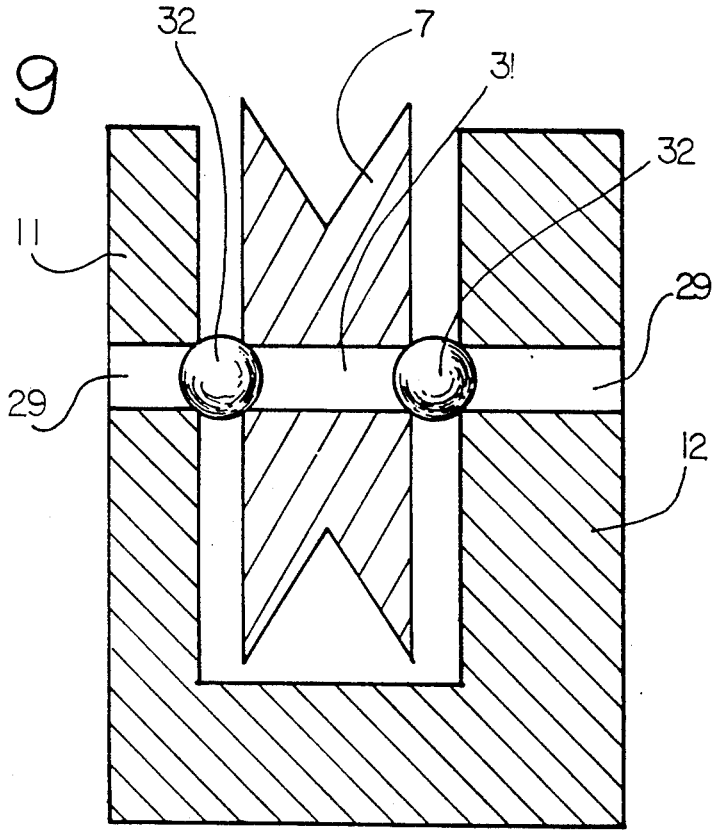
FIG. 9 is a cross sectional view showing the bearing structure of a roller of a roller bridge saddle according to a eighth embodiment of the present invention.

In the eighth embodiment shown in FIG. 9, the saddle body is identical to that of the sixth embodiment. The eighth embodiment varies from the preceding embodiments in that the pins 8 are omitted from the roller 7 and an axial hole 31 is formed therethrough. Ball bearings 32 which are larger in diameter than the holes 31 and 29 are disposed in the spaces between the roller 7 and the walls 12 and 11. Spring force of the elastic wall 11 keeps the ball bearing seated in the holes 31 and 29 with sufficient force to prevent them from being dislodged so as to cause the roller to become displaced.

Figure 10:
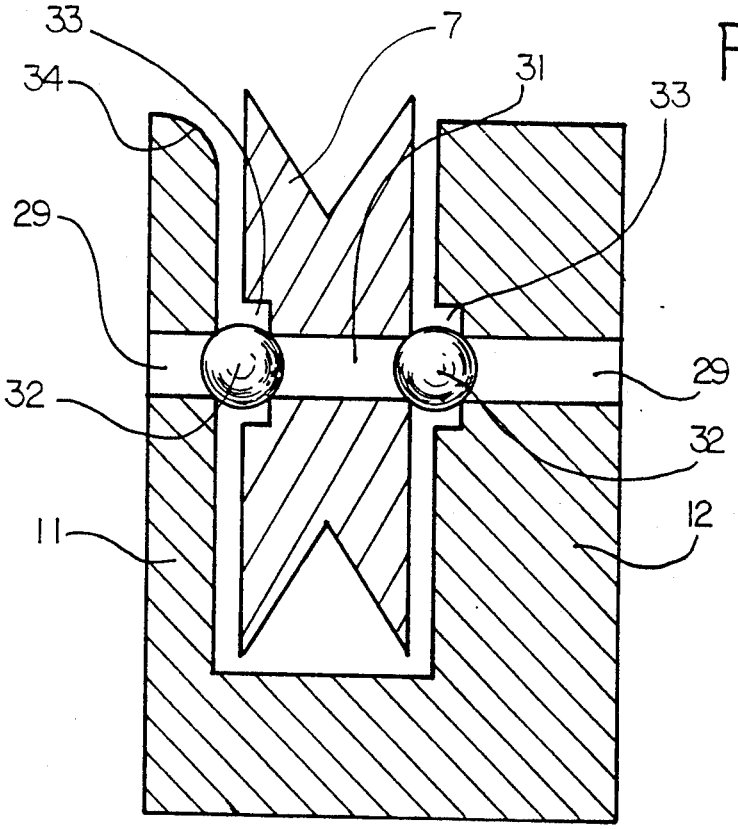
FIG. 10 is a cross sectional view showing the bearing structure of a roller of a roller bridge saddle according to a ninth embodiment of the present invention.

The ninth embodiment shown in FIG. 10 is identical to the eighth embodiment except that shallow indentations 33 larger in diameter than the ball bearings 32 are provided in one wall 12 of the saddle support structure and in one side of the roller 7. The indentations 33 are coaxial to the holes 29 and 31 and can be filled with heavy grease which serves to hold the ball bearings in place as the roller 7 is inserted during assembly. The wall 34 may have a beveled section at the top side for preventing the ball bearing from being dislodged during insertion. Preferably the wall gradually increases in stiffness as the ball bearing approaches the seating position from the top.

Figure 11:
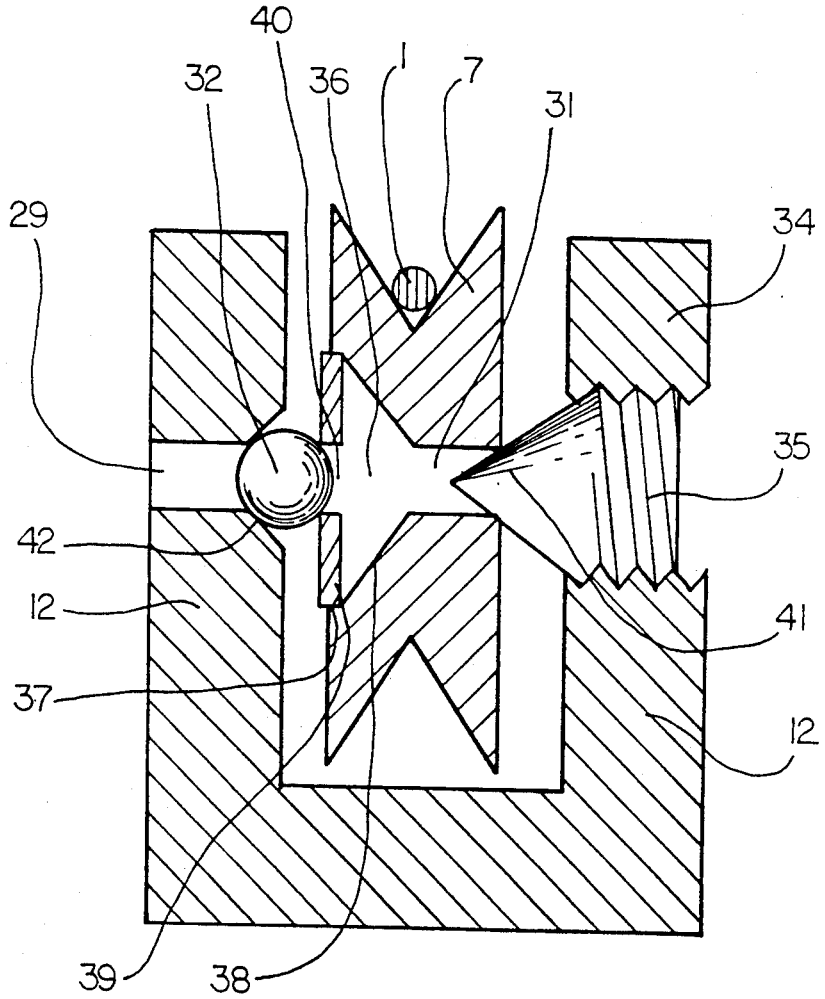
FIG. 11 is a cross sectional view showing the bearing structure of a roller bridge saddle according to a tenth embodiment of the present invention.

In the tenth embodiment shown in FIG. 11 both walls 12 of the support structure are rigid. A ball bearing 32 is partially received in a shallow hole 42 and seats in a hole 29 which is coaxial thereto. In the other rigid wall 12 a threaded hole 34 is formed in which a set screw 35 is threaded. The set screw has a tapering section 41 which protrudes into a hole 31 in the roller 7.

Although the hole 42 is formed as a conical indentation it serves the identical function to that 33 in the previous embodiment.

In one side of the roller 7 a shallow indentation is formed. The indentation 36 is of substantial diameter and preferably has a shallow cylindrical section 37 at the top and a conical indentation 38 at the bottom. An annular washer shaped member 39, whose diameter is very near that of the cylindrical section of the hole 37, is received in the indentation 36. The ball bearing 32 is partly received in the hole 40 at the center of the member 39.

Tightening of the set screw 35 causes the roller 7 to be driven in the direction of the ball bearing 32 causing the ball bearing 32 to be urged into the hole 40 of the washer shaped member 39. Further tightening the screw 35 causes the washer shaped member to elastically deflect inwards thus elastically biasing the roller 7 against the conical protruding portion 41 of the screw 35 causing it to become stably seated in the hole 31. The conical section 38 of the indentation 36 allows the central portion of washer shaped member 39 to elastically deflect inwards.

Thus the coupling between the protrusion of the set screw 35 and the hole 29 of the roller serves to give the roller lateral and radial rigidity, while the washer shaped member serves to maintain constant contact between the roller and the support structure as did the flexible side member 11 in the previous embodiments.

It will be noted that instead of the ball bearing 32 a protrusion could be formed at the center of the member 38 instead of the hole 40 the protrusion would seat in the bearing seating 42 in the manner of a pin.

Figure 12:
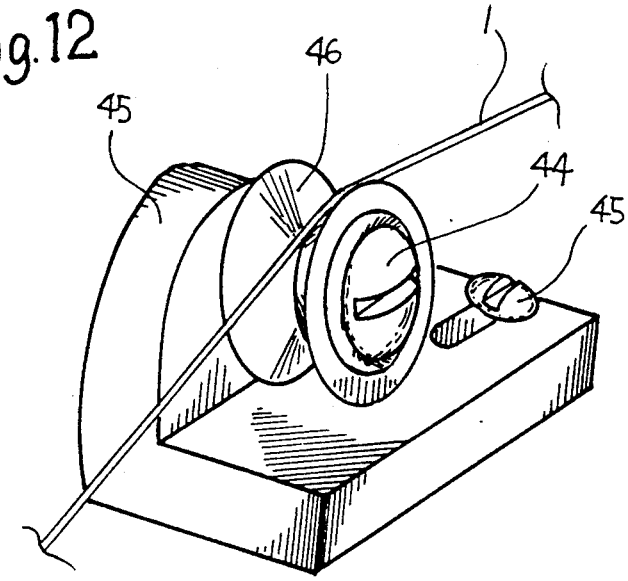
FIG. 12 is a perspective view showing an example of a bridge saddle configuration of a type in which the bearing arrangements of the eleventh through fifteenth might be applied to advantage.

In a roller bridge saddle of the type depicted in FIG. 12, the roller is supported and fixed onto a rigid, L-shaped support structure 43 by a screw 44. A screw 45 serves to hold the support structure on the bridge structure (not shown). The roller 46 serves the identical function as that 7 in the previous embodiments.

Since the roller 46 is supported by the screw 44 and must revolve therearound, in order to allow the roller to revolve freely, it is preferable to provide ball bearings between the roller 46 and the screw.

In the ball bearings of prior art devices lateral play exists. In order to achieve the laterally rigid coupling sought by the invention attention has been given to the form of the bearing races.

Figure 13:
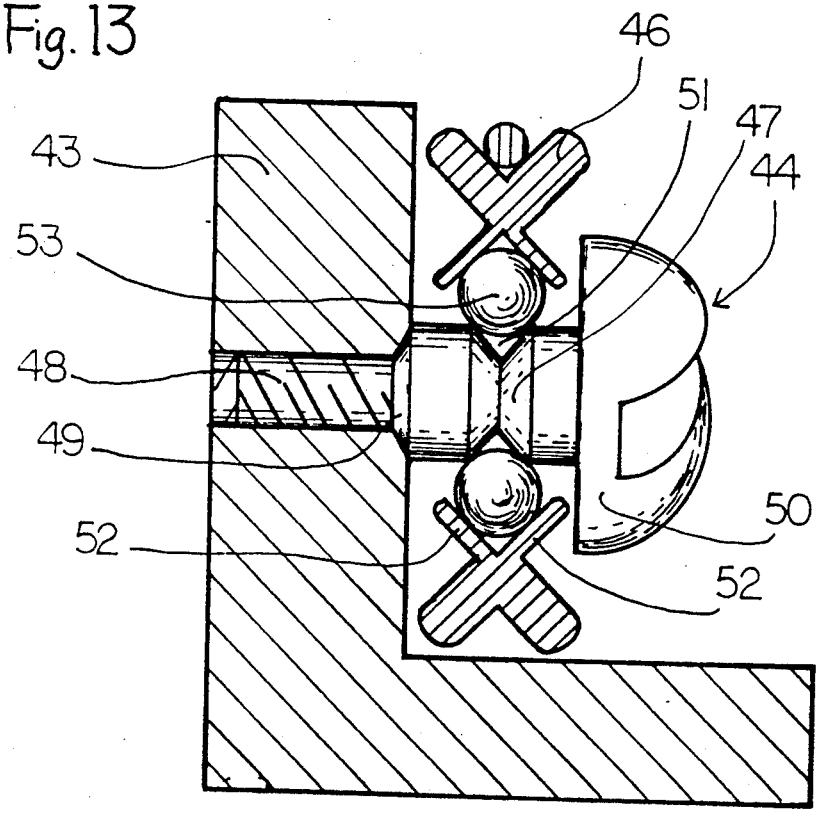
FIG. 13 is a cross sectional view showing the bearing structure of a roller bridge saddle according to a eleventh embodiment of the present invention.

In FIG. 13 a bearing structure according to the eleventh embodiment of the invention is shown. In the bearing structure according to the eleventh embodiment a bearing race is formed directly on the shank of the screw 44.

The screw 44 has a threaded section of a smaller diameter than that of the section of the shank on which the race 47 is formed. Therefore when the screw is threaded into the support structure 43 the shoulder 49 abuts the surface of the structure 43 so to define a stop for the screw 44 at a position in which a space is left between the head 50 and the surface of the support structure 43.

The roller 46 has a V-groove 51 around its inner periphery for defining a bearing race. The V-groove is defined by flexible frusto-conical portions 52. The inner diameters of the frusto-conical portions are selected such that in order to accommodate the ball bearings 53 in the groove 47 the portions 52 must be deflected slightly outwards. Thus the ball bearings are elastically urged into the groove 47 by the elastic biasing force of the sections 52. Due to this biasing force each of the bearings are constantly in two point contact with each of the V-grooves thus eliminating any space in which play could occur therebetween.

Thus the bearing arrangement according to the eleventh embodiment provides a connection between the roller 46 and the support structure 43 which is laterally fairly stiff, thus greatly reducing the vibrational energy loss that would occur using conventional ball bearings in which a certain degree of lateral play is allowed.

Thus the number of parts according to the eleventh embodiment is reduced from that in conventional bearing structures because the inner race is formed on directly on screw. Also advantageous is the fact that diameter of the inner race can be minimized and therefore the rotational friction of the roller can be minimized due to the large mechanical advantage of the rotating force acting at the large diameter outer side of the roller on such a small diameter inner race.

It will be noted that although the eleventh embodiment structure eliminates play in the ball bearings and laterally stiffens the connection between the screw and the roller, due to the elasticity of the sections 52 some lateral flex still tends to occur.

Figure 14:
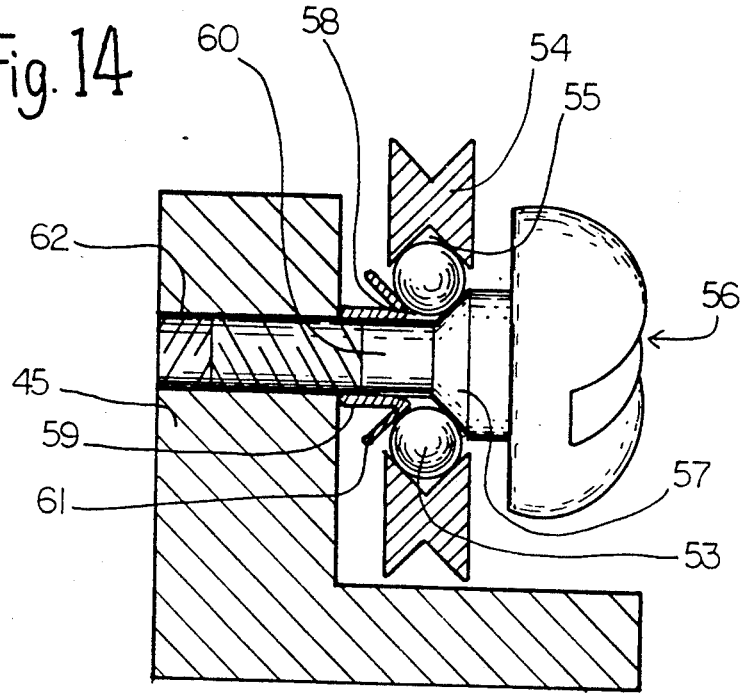
FIG. 14 is a cross sectional view showing the bearing structure of a roller bridge saddle according to a twelfth embodiment of the present invention.

In the twelfth embodiment of the invention shown in FIG. 14, the roller 54 including the bearing race 55 is essentially rigid. The screw 56 which holds the roller 54 on the support structure 43 has a frusto-conical section 57 which defines one side of a V-groove 58 for defining a bearing race. The other side of the bearing race 58 is defined by an elastic member 59. Ball bearings 53 are received in the race 58 and the race 55 commonly.

The elastic member 59 is comprised of a cylindrical section which encircling a section 60 of the shank of the screw 56, and a flexible frusto-conical section 61 which angles away from the cylindrical section 59. The cylindrical 59 section is wider than the conical section 61. Therefore, when the screw is tightened in the hole 62 in the support member 43 the free end of the cylindrical portion abuts the surface of the support member 43.

With the above structure when the screw 56 is tighted into the hole 62, the elastic member is pushed toward the conical section 57 on the shank of the screw 56 so as to narrow the width of the V-groove 58. This narrowing of the groove 58 elastically urges the ball bearings 53 outward into the race 55 of the roller 54 and against the rigid conical section 57 of the screw 56. By adjusting the depth of the screw 56 the stiffness of the bearing structure can be adjusted.

With the bearing of the twelfth embodiment, since the ball bearings are elastically urged against the rigid surface 57 and the rigid race 55 the lateral flexing mentioned above in connection with the eleventh embodiment can be eliminated providing yet further improved sustain characteristics to the bridge saddle.

Figure 15:
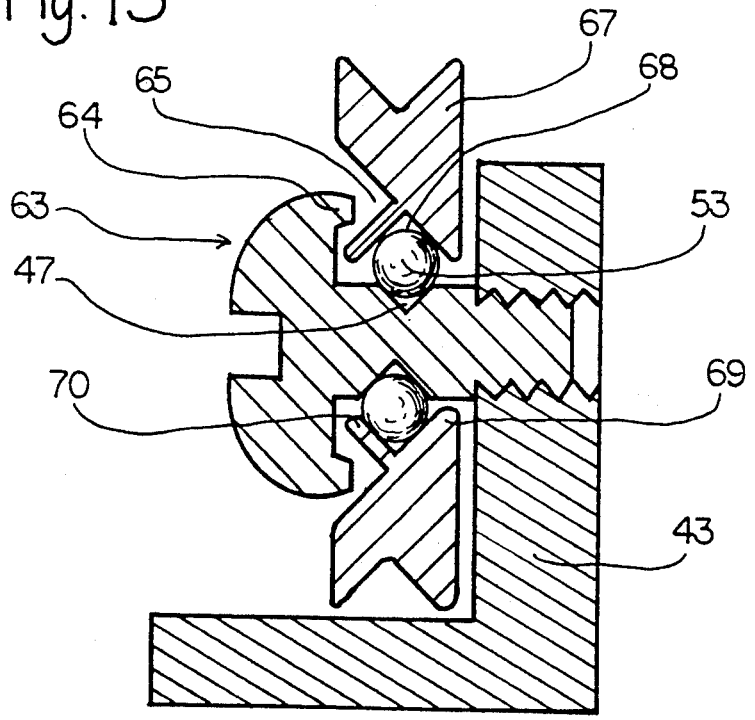
FIG. 15 is a cross sectional view showing the bearing structure of a roller bridge saddle according to a thirteenth embodiment of the present invention.

In the thirteenth embodiment of the invention shown in FIG. 15 the screw is essentially identical to that 44 in the eleventh embodiment in every respect except that a lip is provided on the upper surface for partially projecting into a groove in the roller 67 so as to somewhat deter the entry of foreign matter into interior of the bearing.

The screw 63 comprises a race 47 in which ball bearings 53 are received.

The roller 67 comprises a race 68 defined on its inner periphery for receiving the ball bearings 53. The race 68 is defined on one side by a rigid frusto-conical section 69 and at its other side by a flexible frusto-conical section 70. The diameter of the race 68 is such that in order to receive the ball bearings in the race 47, the flexible frusto-conical section 70 must be deflected slightly outwards. Therefore, the flexible section 70 urges the bearings into the groove 47 in the screw 63 and against the rigid side 69 of the race 68 of the roller 67.

As in the previous embodiments, by selecting the biasing force of the member 70 so as to be greater than the lateral force imposed, by vibration of the string, on the roller 67 the effect of a laterally rigid connection between the roller 67 and the support structure 43 is achieved.

Figure 16:
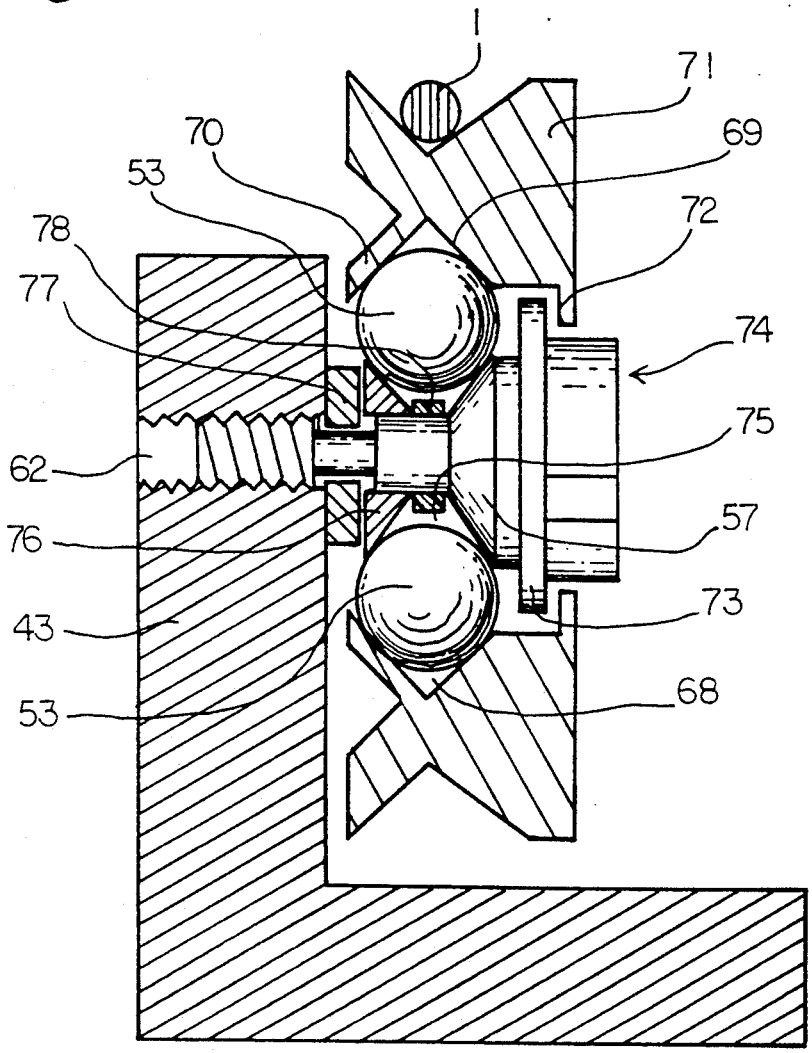
FIG. 16 is a cross sectional view showing the bearing structure of a roller bridge saddle according to a fourteenth embodiment of the present invention.

In the fourteenth embodiment shown in FIG. 16, the roller 71 comprises a rigid side 69 of the race 68 and a flexible side 70 as in the thirteenth embodiment. The roller 71 also comprises a lip 72 which overlaps a lip 73, on the screw 74 for keeping foreign matter out of the interior of the bearing.

The screw 74 comprises a frusto-conical section 57 for defining one side of a bearing race the other side of which is defined by a frusto-conical ring member 76. A stop ring is disposed in an annular groove 78 for preventing the ring 77 from coming off of the screw 74 when the screw 74 is not threaded into a receptacle.

Although the ring 77 in the figure is of a small diameter it could be made of a large diameter so as to overlap the side of the roller 71 so as to prevent the entry of foreign matter into the interior of the bearing.

When the screw 74 is rotated so as to enter the hole 62 in the support structure 43 the stop ring 77 is urged against the ring member 76 which in turn is urged against the ball bearings 53. This in effect narrows the race 75 forcing the ball bearings 53 outward into the race 68. The flexible member 70 elastically accommodates this outward movement of the bearings 53. The effect is that the force that the member 70 applies to the bearings 53 can be adjusted by the screw 74. Thus the overall stiffness of the bearing structure of the thirteenth embodiment can be adjusted by the depth of insertion of the screw 74 into the hole 62 of the support structure 43.

In order to provide some resistance to rotation of the screw 74 an elastic ring 78 of plastic or other material is disposed in the space between the ring 76 and the frusto-conical section 57. The ring 78 is compressed between the ring 76 and the frusto-conical section 57 when the screw 74 is driven into the hole 62. This provides some resistance to the rotation of the screw 74 so as to prevent it from loosening due to vibrations.

It will be noted that the flexible section 70 could be omitted and a stiff spring washer could be disposed between the surface of the support member 43 and the stop ring 77. In this case tightening of the screw would elastically urge the spring washer against the stop ring 77 which would bear on the ring 76 so as to tighten the ball bearings into the race in the roller the elasticity of the connection would be supplied by the spring washer.

Figure 17:
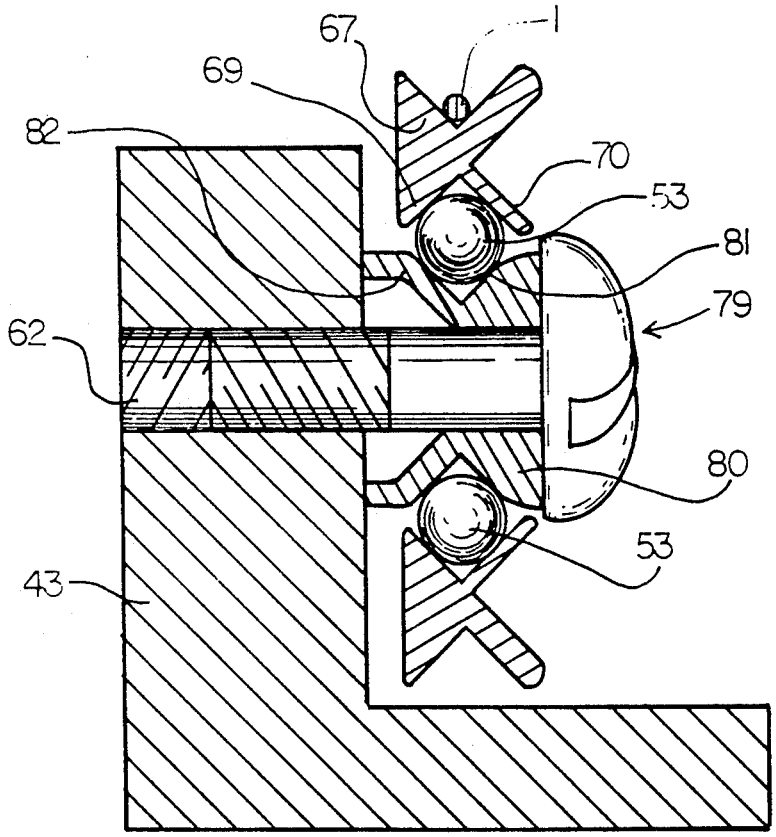
FIG. 17 is a cross sectional view showing the bearing structure of a roller bridge saddle according to a fifteenth embodiment of the present invention.

In the fifteenth embodiment of the invention shown in FIG. 17 the roller is identical to that of the thirteenth embodiment. The screw 79 of the fifteenth embodiment, which holds the roller on the support structure 43 is a conventional round headed machine screw.

Around the shank of the screw 79 a race member 80 is disposed having a rigid side 81 and a flexible side 82. The race member 80 is slidable along the axis of the screw 79.

When the screw is driven into the hole 62 in the support structure 43 the race member 80 becomes compressed and the angle of the groove defined by the sides 81 and 82 is sharpened forcing the ball bearings 53 outwards into the race of the roller 67.

Thus as in the previous embodiment the overall stiffness of the bearing can be selected by selecting the depth to which the screw 79 is inserted into the support structure 43 and the effect of an essentially laterally rigid connection between the roller 67 and the support structure 43 can be obtained.

It will be appreciated by those skilled in the art that in a roller bridge saddle according to the invention lateral play is eliminated thus improving the sustain characteristics of the instrument on which the roller bridge saddle is mounted.

It will further be appreciated by those skilled in the art that although the above embodiments are disclosed with reference to a bridge saddle of a musical instrument the same principles could easily be applied to a roller nut as well as the string guides. It will further be apparent that the principles of the bearings according to the invention could also be applied to rollers not intended for musical instruments at all.

What I claim is:

1. A roller string guide for a string of a musical instrument comprising:

a roller for guiding a section of said string;

a bearing means, said bearing means being defined on said roller for defining a rotational axis of said roller, said rotational axis intersecting a plane containing a longitudinal axis of said string at substantially right angles thereto;

an elastic biasing means, said elastic biasing means elastically urging said roller in a first direction said first direction being substantially coaxial to said rotating axis; and rigid seating means, said rigid seating means rigidly defining a limit of movement of said roller in said first direction.

2. A roller string guide as set forth in claim 1 wherein said roller string guide defines a bridge saddle.

3. A roller string guide as set forth in claim 1 wherein said bearing means comprises a first pin rigidly attached to said roller at said rotational axis thereof and said rigid seating means is formed by a first conical indentation.

4. A roller string guide as set forth in claim 3 wherein said conical indentation is formed in an interior wall of a groove defined in a rigid channel member and said elastic biasing means is provided on a side of said groove opposing said first conical indentation.

5. A roller string guide as set forth in claim 4 wherein said elastic biasing member is flexible in the directions parallel to said rotational axis of said roller and is substantially rigid in the directions normal to said rotational axis of said roller.

6. A roller string guide comprising:

a roller, said roller having a first pin protruding at a first lateral side thereof and a second pin protruding at a second lateral side thereof for defining a rotational axis of said roller;

a first seating means, said first seating means receiving said first pin;

a second seating means for receiving said second pin;

an elastic biasing means, said elastic biasing means having said second seating means defined thereon.

7. A roller string guide comprising:

a roller bearing means, said bearing means defining a rotational axis of said roller; and an elastic channel member, said elastic channel member defining a channel in which said roller and said bearing means are defined and said elastic channel member defining an elastic biasing means for applying a spring force to said bearing means in a direction substantially coaxial to said rotational axis of said roller.

8. A roller string guide as set forth in claim 7 wherein said elastic channel member is received in a rigid support member said rigid support member defining a main body of said roller string guide.

9. A roller string guide as set forth in claim 8 wherein said rigid support member comprises a first wall portion said first wall portion stiffening a first side of said channel so as to make it essentially rigid.

10. A roller string guide as set forth in claim 9 wherein said rigid support member comprises a second wall portion, said second wall portion partially engaging a second side of said channel member so as to stiffen said second side of said channel member to a lesser degree than the degree to which said first side of said channel member is stiffened.

11. A roller guide for a filament comprising:

a roller for guiding a section of said filiment;

a bearing means, said bearing means being defined on said roller for defining a rotational axis of said roller, said rotational axis intersecting a plane containing a longitudinal axis of said filiment at substantially right angles thereto;

an elastic biasing means, said elastic biasing means elastically urging said roller in a first direction with a constant spring force said first being substantially coaxial to said rotating axis; and rigid seating means, said rigid seating means rigidly defining a limit of movement of said roller in said first direction.

12. A roller string guide comprising:

a roller an axis defining means, said axis defining means defining a rotational axis about which said roller can rotate freely, said rotational axis being the sole rotational axis of said roller;

an elastic bearing means, said elastic biasing said roller in a first direction defined coaxially to said roller;

a rigid seating means, said rigid seating means rigidly defining a limit of movement of said roller along said rotational axis in said first direction.

* * * * *